US005443896A

United States Patent [19]

Rebouillat

[11] Patent Number: 5,443,896

[45] Date of Patent: Aug. 22, 1995

[54] SURFACE TREATED ARAMID FIBERS AND A PROCESS FOR MAKING THEM

[75] Inventor: Serge Rebouillat, Midlothian, Va.

[73] Assignee: E. I. Du Pont de Nemours and Company, Wilmington, Del.

[21] Appl. No.: 79,652

[22] Filed: Jun. 23, 1993

Related U.S. Application Data

[62] Division of Ser. No. 844,270, Mar. 2, 1992, Pat. No. 5,275,625.

[30] Foreign Application Priority Data

Mar. 2, 1991 [DE] Germany ..... 41 06 748.7

[51] Int. Cl.[6] ..... B32B 7/00; D03D 3/00

[52] U.S. Cl. ..... 428/267; 428/224; 428/225; 428/245; 428/260; 428/265; 428/289; 428/290; 428/395; 8/115.62; 8/115.61

[58] Field of Search ..... 428/395, 224, 375, 911; 8/115.62

[56] References Cited

U.S. PATENT DOCUMENTS

| | | | |
|---|---|---|---|
| 3,223,543 | 12/1965 | Savina | 106/213 |
| 3,287,324 | 11/1966 | Sweeny . | |
| 3,869,429 | 3/1975 | Blades | 264/184 |
| 3,957,574 | 5/1976 | Anderson | 162/167 |
| 4,043,863 | 8/1977 | Bjorklund et al. | 162/158 |
| 4,123,319 | 10/1978 | Bjorklund et al. | 162/158 |
| 4,296,012 | 10/1981 | Okumichi et al. | 162/168 R |
| 4,350,788 | 9/1982 | Shimokawa et al. | 524/309 |
| 4,405,408 | 9/1983 | Yoshioka et al. | 162/158 |
| 4,619,854 | 10/1986 | Penttinen | 428/99 |
| 4,670,343 | 6/1987 | Makino et al. | 428/395 |
| 5,017,268 | 5/1991 | Clitherow et al. | 162/146 |
| 5,028,236 | 7/1991 | Kortmann et al. | 8/128.1 |
| 5,275,625 | 1/1994 | Rebouillat | 8/115.62 |

FOREIGN PATENT DOCUMENTS

| | | |
|---|---|---|
| 037892 | 10/1981 | European Pat. Off. . |
| 107887 | 5/1984 | European Pat. Off. . |
| 136727 | 4/1985 | European Pat. Off. . |
| 163403 | 12/1985 | European Pat. Off. . |
| 231927 | 8/1987 | European Pat. Off. . |
| 239915 | 10/1987 | European Pat. Off. . |
| 0261820 | 3/1988 | European Pat. Off. . |
| 332919 | 9/1989 | European Pat. Off. . |
| 0354397 | 2/1993 | European Pat. Off. . |
| 50-53608 | 5/1975 | Japan . |
| 57-101094 | 6/1982 | Japan . |
| 60-258245 | 12/1985 | Japan . |
| 62-97967 | 5/1987 | Japan . |
| 62-243620 | 10/1987 | Japan . |
| 62-243628 | 10/1987 | Japan . |
| 2221928 | 2/1990 | United Kingdom . |

OTHER PUBLICATIONS

Research Disclosure, May 1978, No. 169, disc. 16949.
Research Disclosure, Jul. 1980, disc. 19520.

*Primary Examiner*—Patrick J. Ryan
*Assistant Examiner*—J. M. Gray

[57] ABSTRACT

The invention relates to highly processable, hydrophobic aramid fibers of high modulus, improved surface frictional properties, scourability, low abrasion depositing, low fibrillation obtainable by surface reaction of an aromatic polyamide fiber with a surface reactant comprising a ketene dimer $$[R^1R^2C_2O][R^1R^2C_2O] \quad (I).$$

The invention further relates to a process for the production and the use of said fibers.

1 Claim, No Drawings

SURFACE TREATED ARAMID FIBERS AND A PROCESS FOR MAKING THEM

This is a division of application Ser. No. 07/844,270, filed Mar. 2, 1992, now U.S. Pat. No. 5,275,625.

BACKGROUND OF THE INVENTION

1. Field of the Invention

The present invention relates to hydrophobic aramid fibers and to a process for making them.

During the manufacture of aramid fibers, a processing finish is often used. For certain applications, for example, in impregnation of the fibers or a woven product, processing finish which is still present on the fibers must be removed. Thereafter, fluoro-containing compounds as water repellent agent are applied to the fibers in the woven product.

The nature of the fiber-resin interface in aramid composites is especially important. It is also known that the aramid yarns used, for example, in filament wound structures such as pressure vessels or in hard ballistic protective armours, such as helmets, perform better when the fiber-to-resin adhesion level is well controlled.

2. Description of the Prior Art

UK Patent Application No. 2,221,928, published Feb. 21, 1990 discloses treatment of textile materials with ketene dimers to impart water repellant properties thereto. The textile materials of the publication are primarily wool, cotton, and polyester/cotton blends. The textile materials treated in that publication are always dried and are never disclosed to be solvent- or water-swollen.

However, the finishes according to this reference are not suitable for the purposes of the present invention in terms of surface frictional properties, hydrophobic and use of the .resulting fibers in resin composites. The above-mentioned reference does not yield fibers having the desired properties and which are ready to be used.

Japanese Patent Application Kokai 60-258 245 relates to an aqueous dispersion containing a ketene dimer, a cationic acrylamide polymer, and an anionic dispersing agent, for the treatment of cellulose fiber textiles in order to generate softness and water-repellency.

Therefore, it is one object of the present invention to provide a ready to use tailored engineered surface energy aramid fiber for applications where reduced or no water dynamic sorption and well controlled and low fiber surface energy are needed. Ready to use means that the aramid fiber is not subjected to further treatment such as removal of the processing finish, applying of a water repellent or adjusting the fiber to resin level for composite application.

It is another object of the present invention to offer a process by way of which the ready to use fiber is produced. Continuous (in-line) and batch-wise (off-line) processes for producing the modified aromatic polyamide fibrous material have to be provided.

Another object of the present invention is to provide an aramid fibrous material, useful for reinforcing rubber and composite articles or other polymeric matrices (epoxy, polyester, phenolic polymers), for materials which involve in their production a twisting, knitting, braiding, spiralling or weaving operation.

Another object of this invention is to provide a highly processable aramid element (yarn, thread, cord, staple, pulp, short fibers) usable as a reinforcing element for elastomeric and traditional composites. The improved processability of this product leads to higher performance of the final system (for example, higher strength conversion in fabrics).

Another object of the invention is to provide aramid fibers which can be used without twisting in production lines which involve for example a knitting or weaving operation of a single yarn. When used in a twisted form, for example in a cord, the tenacity and modulus of the aramid element is better utilized in the final cord structure than with commercially available products.

It has surprisingly been found that by the treatment of never-dried aramid fibers by means of a surface reactant, the processability, hydrophobicity and the fiber-to-resin adhesion level are improved. At the same time, toxicological risks by the use of formerly used fluorine-containing water repellents at high temperature as well as the potential bond degradation by the use of formerly used silicone oils for the control of the fiber-to-resin level are obviated.

According to this invention, the application of certain surface reactants for reaction on the surface of never-dried aramid fibers provides a new surface enhanced fiber which exhibits not only excellent processability characteristics with respect to friction, but also a completely hydrophobic surface. The resultant fibers exhibit a low wickability and an enhanced glycol resistance, the latter being extremely important for e.g. composite materials in automobile radiator systems. The fibers also show reduced discoloration kinetics if exposed to daylight. The hardness of the bobbins (package density) of the fibers according to the invention is also significantly improved. The use of the surface reactant further obviates additional steps of treatment by which the fiber-to-resin adhesion level is controlled for the application as a reinforcing element for composite applications or obviates additional scouring and fluoro-treatment of fabric woven structures. Fabrics made, of the tailored surface energy fiber of this invention exhibit higher wearing comfort due to increased air permeability and vapor transport.

The end use performance of the final system is consequently significantly improved.

SUMMARY OF THE INVENTION

The present invention relates to highly processable, hydrophobicity aramid fibers of high modulus, improved surface frictional properties, improved scourability, low abrasion depositing, low fibrillation obtained by reaction of the surface of a never-dried aramid fiber with a surface reactant to yield a coated fiber wherein the surface reactant, comprises a ketene dimer of the general formula $$[R^1R^2C_2O].[R^{1'}R^{2'}C_2O] \quad (I)$$

wherein each of the groups $R^1$ and $R^{1'}$, which may be same or different, represent an alkyl, cycloalkyl, aryl, alkenyl aralkyl, aralkenyl or, alkaryl, having from 4 to 32 carbon atoms; and each of the groups $R^2$ and $R^{2'}$, which may be same or different, represent a hydrogen atom or an alkyl or alkenyl group having from 1 to 6 carbon atoms, (1) as neat liquid, or (2) as 1 to 60% by weight solution in an inert organic solvent, or (3) as aqueous emulsion, said aqueous emulsion being obtainable by adding 1 to 60% by weight of said ketene dimer to an aqueous mixture having a pH of 2.5 to 5 comprising (i) 0.25 to 10% by weight of a cationic water soluble polymer, and (ii) 0.05 to 5% by weight of an alkali metal lignosulfonate or sodium naphthalene formaldehyde sulfonate condensate and subsequently stirring and homogenizing to a particle size of less than 0.5 micron.

DETAILED DESCRIPTION OF THE INVENTION

Aramid fibers, spun or prepared from a solution and coagulated in an aqueous bath, have been found to be more readily treated by materials which are reactive with groups present on the aramid molecules which the fibers are in the so-called never-dried condition. Attempts at performing the reaction between ketene dimer and surface aramid molecules of an already dried fiber have proven much less successful, apparently due to the reduced availability of surface aramid reaction sites. In the present invention surface aramid molecules are reacted with ketene dimers to afford a coating on the aramid fibers when the fibers are subsequently dried.

The coating which results from the reaction between the surface of the never-dried aramid fibers and the ketene dimer yields several advantages; first, it renders the fiber processable during the manufacture thereof; second, it renders the obtained fiber hydrophobic; and third, it coffers a controlled fiber-to-resin adhesion to the fiber.

In relation to the above definition of a compound of formula (I), preferred alkyl or alkenyl groups $R^1$, $R^{1'}$ contain from 8 to 24, more preferably 14 to 24 carbon atoms.

Preferably, each of the groups $R^1$, $R^{1'}$ independently represents an alkenyl or an alkyl group.

The alkyl and alkenyl groups for $R^1$, $R^{1'}$ are selected from octyl, decyl, dodecyl, tetradecyl, tetradecenyl, hexadecyl, hexadecenyl, octadecyl, octadecenyl, eicosyl, eicosenyl, docosyl, docosenyl, tetracosyl, and tetracosenyl.

Preferred alkyl and alkenyl groups $R^2$, $R^{2'}$, which may be same or different, contain 1–6 carbon atoms, preferably selected from alkyl-$C_1$–$C_3$ and alkenyl-$C_1$–$C_4$. Most preferred for $R^2$, $R^{2'}$, however, is hydrogen.

In a particularly preferred method according to this invention, the ketene dimers employed are tetradecyl, tetradecenyl, hexadecyl, hexadecenyl, eieosyl, and eicosenyl ketene dimers.

The ketene dimer based surface reactant according to the invention can be applied to the fiber in different manners. The ketene dimer can be applied in the neat, liquid form. It is applied at a temperature below 100° C., preferably between 40° and 80° C.; and, if necessary, is melted prior to application.

The ketene dimer can also be dissolved in a suitable inert organic solvent. Suitable solvents are alcohols, such as iso-propyl alcohol; alkanes, such as n-hexane, heptane, octane, nonane, decane; and aromatic solvents, such as, toluene, o-, m- or p-xylene, mesitylene; and dichloroalkanes. The concentration of the ketene dimer in the solvent is generally 1 to 60% by weight.

The ketene dimer can be emulsified at 1 to 60% by weight of said ketene dimer in a pH-adjusted aqueous mixture of 0.25 to 10% by weight of a cationic water soluble polymer and 0.05 to 5% by weight of an alkali metal lignosulfonate.

Cationic water soluble polymers include: cationic amine modified starch, cationically-charged vinyl addition polymers, and the like. Cationically-charged vinyl addition polymers include quaternary salts of polyacrylamide, polymethacrylamide and materials modified by Mannich reactions and further quaternarized.

Cationic water soluble polymers used as stabilizers and emulsifiers for the ketene dimers in practice of this invention can be homopolymers, copolymers, or blends; and nonionic and anionic water soluble polymers can be used in combination with the cationic polymers so long as the overall charge of the combination is cationic.

The cationic amine modified starch is represented by the formula $$R_s—(O—R^3—NR^4R^5)_n$$

where n in the degree of substitution of the starch molecule and is 0.005 to 3, $R_s$ is starch, $R^3$ is an alkylene, hydroxyalkylene, phenylalkylene or alkylalkylene group and $R^4$ and $R^5$ are each an alkyl, alkenyl, alkaryl, aralkenyl aryl, aralkyl cycloalkyl group or a hydrogen atom.

The cationic amine modified starch which is used in this system as a stabilizer and emulsifier and is more completely described in U.S. Pat. No. 3,130,118. Other patents describing cationizing agents are U.S. Pat. Nos. 3,821,069; 3,854,970; 4,029,885.

The pH of the emulsifier solution is generally adjusted to 2.5 to 5 with an appropriate acid such as acetic, or hydrochloric acid and then the ketene dimer is added in a liquid condition. Upon completion of the dimer addition, the mixture can be further homogenized to produce an emulsion with a particle size less than 0.5 micron.

Within the scope of the invention, by fibers are understood continuous filaments as well as a single yarn or cord, staple fibers, fiber tows (for example for stretched breaking processes), yarns or flat textile skeins, staple crimped fibers, pulps, industrial woven, twisted, knitted, braided, spiralled or wrapped textile from aromatic polyamides with fiber type structure.

Never-dried aramid fibers are in a swollen uncollapsed, state and include 15–200, weight, percent, preferably at least 20, and most preferably 30 to 70 weight, percent water, based on the weight of the dried fiber.

Aramid fibers are fibers of polymers that are partially, preponderantly or exclusively composed of aromatic rings, which are connected through carbamide bridges or optionally, in addition also through other bridging structures. The structure of such aramids can be elucidated by the following general formula of repeating units:

$$(—NH—A_1—NH—CO—A_2—CO—)_n$$

wherein $A_1$ and $A_2$ are the same or different and signify aromatic and/or polyaromatic and/or heteroaromatic rings, that can also be substituted. Typically $A_1$ and $A_2$ may independently from each other be selected from 1,4-phenylene, 1,3-phenylene, 1,2-phenylene, 4,4'-biphenylene, 2,6-naphthylene, 1,5-naphthylene, 1,4-naphthylene, phenoxyphenyl-4,4'-diylene, phenoxyphenyl-3,4'-diylene, 2,5-pyridylene and 2,6-quinolylene which may or may not be substituted by one or more substituents which may comprise halogen, $C_1$–$C_4$-alkyl, phenyl, carboalkoxyl, $C_1$–$C_4$-alkoxyl, acyloxy, nitro, dialkylamino, thioalkyl, carboxyl and sulfonyl. The —CONH— group may also be replaced by a carbonylhydrazide (—CONHNH—) group, azo- or azoxygroup.

Further useful polyamides are disclosed in U.S. Pat. No. 4,670,343 wherein the aramid is a copolyamide in which preferably at least 80% by mole of the total $A_1$ and $A_2$ are 1,4-phenylene and phenoxyphenyl-3,4'-diylene which may or may not be substituted and the content of phenoxyphenyl-3,4'-diylene is 10% to 40% by mole.

Fibers derived from wholly aromatic polyamides are preferred.

Examples of aramids are poly-m-phenylene-isophthalamide and poly-p-phenylene-terephthalamide.

Additional suitable aromatic polyamides are of the following structure $$(-NH-Ar_1-X-Ar_2-NH-CO-Ar_1-X-Ar_2-CO-)_n$$

in which X represents O, S, $SO_2$, NR, $N_2$, $CR_2$, CO

R represents H, $C_1$–$C_4$-alkyl and $Ar_1$ and $Ar_2$ which may be same or different are selected from 1,2-phenylene, 1,3-phenylene and 1,4-phenylene and in which at least one hydrogen atom may be substituted with halogen and/or $C_1$–$C_4$-alkyl.

Additives can be used with the aramid and, in fact, it has been found that up to as much as 10% by weight, of other polymeric materials can be blended with the aramid or that copolymers can be used having as much as 10% of other diamine substituted for the diamine of the aramid or as much as 10% of other diacid chloride substituted for the diacid chloride of the aramid.

The invention further relates to a process for the production of highly processable water-repellent aromatic polyamide fibers as defined above comprising the steps of applying the ketene dimer surface reactant, as defined above, to the aramid fiber heating the fiber to between 30° and 400° C. and optionally repeating the application of the surface reactant at least once and optionally repeating the heating of the fiber after each application.

The coating of the aramid fibers with the ketene dimer surface reactant of L5 this invention can take place in various ways and more specifically according to the processes described in the following.

The ketene dimer surface reactant can be applied "in-line" or "off-line";—in-line meaning that the fibers are coated during the spinning process and off-line meaning that the fibers have been removed from the spinning process and are coated from spools or bobbins or the like.

In the process of this invention, the ketene dimer surface reactant is applied to the never-dried fibers and the fibers are then dried and, if desired or required for some particular result, stretched and/or heat treated. Aramid fibers are generally spun into an aqueous coagulating bath, such as is taught in U.S. Pat. No. 3,767,756, and the water-swollen fibers are then washed and neutralized before the ketene treatment of this invention. It has been found that, when the water-swollen fibers are neutralized using sodium carbonate, the fiber product of the process of this invention exhibits better overall quality than when sodium hydroxide is used for the neutralization. While the reason for this difference in product quality is not entirely understood, it is believed to relate to an improved reaction between the ketene dimer and its carbonate-neutralized aramid fiber surface.

The application of said surface reactant can, optionally, be repeated after the drying step.

According to the process of this invention, application of the surface reactant is made on a washed fiber substrate using either a finish applicator, a roll applicator with or without doctor blade at the drier-level, a serpentine system or any other device or process known in the art. Ultrasonic systems and known in the art devices can also be used in order to enhance the uniformity or penetration of the agent.

The levels of the surface reactant on the fiber should be in the range of 0.05 to 85 by weight, preferably 0.25 to 2.5% by weight.

Drying may be effected by convection, heat conduction, irradiation, and the like. Heating of the coated fiber is usually carried out for a period of from a few seconds to some minutes, depending on the desired degree of drying and the intended additional treatment.

As an example of a preferred off-line process, never-dried aramid yarn of 1670 dtex (1500 denier) was passed through the ketene dimer surface reactant dip of a Zell-dipping unit to coat it and then it was dried and cured in an air heated chamber at 160° C. with a tension of 3 gpd. Depending on the dip concentration, which may be between 1% and 30% by weight in water, the speed was adjusted to be between 15 and 50 m/min.

The fibers according to the invention are used for the reinforcement of hoses, belts, ropes and cables including optical cables, rubber goods, composite structures (e.g. sporting goods, medical supplies, building and acoustic material, transport and protective equipment for civil and military applications) and protective apparel.

DESCRIPTION OF THE PREFERRED EMBODIMENTS

Preparation of a ketene dimer 177 g of triethylamine or 250 g of tripropylamine are added, at room temperature, to 1100 g of freshly distilled toluene. 400 g of palmitoyl chloride are slowly added to the toluene-tertiary amine mixture while stirring. The temperature is maintained around 50° C. for 2.5 hours while gently stirring. 290 g of acid solution at 50°–60° C., prepared from 260 g of distilled water and 30 g of concentrated hydrochloric acid, are added while stirring to another 45 minutes. The organic phase is decanted and the toluene and other components of this mixture are separated from the ketene dimer by distillation under vacuum while maintaining the temperature as low as possible (40°–60° C.). The yield of the reaction is about 90% compared with the theoretical calculation. The melting point of the palmitic acid based ketene dimer (tetradecyl ketene dimer) thus obtained is about 43° C.

This method can also be used to produce other ketene dimers such as tetradecenyl, hexadecyl, hexadecenyl, eicosyl, eicosenyl, and the like.

Preparation of ketene dimer emulsion.

150 g of cationic potato starch (for example, the product identified as STALOK 400 sold by A. E. Staley corporation) or the same quantity of cationic corn starch or of any commercially available cationic etherified starch, (for example the beta-diethyl aminoethyl chloride hydrochloride ether of corn starch) is cooked for about an hour in 2250 g distilled water at 90° C. This solution is then cooled to 60° C., or about 5° to 10° C. above the melting point of the ketene dimer, and kept at this temperature during the entire emulsion preparation. The pH is adjusted by addition of acetic acid (sufficient quantity to obtain a 3–5 pH). 29 g of sodium naphthalene formaldehyde sulphonate condensate or 24 g of sodium lignin sulfonic acid are added to the starch mixture.

Separately, 360 g of hexadecyl ketene dimer or tetradecyl ketene dimer or other ketene dimers prepared as described above or any commercially available ketene dimer are melted by heating and maintained around 65 ° C. The ketene dimer melt is slowly and continuously poured into the starch solution (maintained at 60° C.) under vigorous stirring. The mixture is further homogenized for 1.5–2 minutes by increasing substantially the shear rate of the mixture. The formulation is rapidly cooled to room temperature and maintained preferably below 30° C., most preferably below 15° C.

This procedure should provide a dispersion containing particles smaller than 0.5 micrometer, and directly usable to treat never-dried fibers by the process of this invention.

In the examples which follow, a ketene dimer surface reactant formulation as set out below was used to coat the surface of aramid fibers in accordance with this invention.

(a) 6% by weight of a hexadecyl ketene dimer
(b) 1.5% by weight of cationic modified starch (commercial cationic potato starch)
(c) 0.33% by weight of sodium lignosulfonate
(d) balance water.

In the examples which follow, results of tests performed on the fibers of this invention are compared with results of the same tests performed on commercially available fibers, produced at the same time and under the same conditions without the surface reactant (termed "Comparison").

EXAMPLE 1

To demonstrate that the surface reaction here performed in the process of this invention has no negative effect on tenacity, never-dried aramid yarn of 1000 denier was coated in-line at about 650 m/min and was then dried at 175° C.

Tenacity of the coated yarn of this invention was found to be 24.9 g/denier which tenacity of the Comparison was 25.2 g/denier. Those results showing that the process of this invention causes no degradation of tenacity.

As a second trial, dried aramid yarn of 1140 denier was coated off-line and dried at 200° C. The coated yarn of this invention exhibited a tenacity and modulus of 24.7 and 913 g/denier while those values for the Comparison were 25.5 and 885 g/denier. Again, the results show that the process of this invention causes no fiber degradation.

The following Examples 2 to 8 show that the fibers produced according to Example 1 have an improved processability, tailored surface functionality, and end-use performance. The tests for Examples 2–8 were performed on aramid fibers produced according to the on-line process of Example 1.

EXAMPLE 2

In this example, a never-dried aramid yarn of 1500 denier was coated to a level of 0.8% using hexadecyl ketene dimer by the process of this invention and the friction coefficient was determined and compared with that of the Comparison yarn. As an additional comparison, a dried 1500 denier aramid yarn was, also, coated to a level of 0.8% using hexadecyl ketene dimer and that fiber was tested.

A Rothschild friction meter R-1182 was used for the friction coefficient determinations.

The yarns were drawn through the friction meter at a rate of 100 m/min; and friction coefficient values were as follows:

| | Never-dried fibers of this Invention | Dried Aramid Fibers | Comparison |
|---|---|---|---|
| fiber-to-fiber | 0.09 | 0.18 | 0.15 |
| fiber-to-metal | 0.20 | 0.40 | 0.30 |
| deposits (mg/kg) | 10 | 55 | 0.40 |

"Deposits", in the Table indicate the amount of material collected on the friction meter during the friction test in milligrams of material per kilogram of fiber drawn through the meter. Increased deposits indicate decreased weaveability of the fibers.

EXAMPLE 3

In this example, fabrics woven from aramid yarn of 1000 denier at 8×8 ends per centimeter were tested for hydrophobicity. One of the fabrics was woven from a yarn treated in the never-dried condition to a level of 0.8% using hexadecyl ketene dimer in accordance with this invention, one was woven from a yarn which was treated in the dried condition to a level of 0.8% using hexadecyl ketene dimer, and one was woven using Comparison yarn. As an additional test, some of the dried aramid yarn was treated to a level of 2.5% of hexadecyl ketene dimer, but that yarn could not be woven into a fabric.

Hydrophobicity was measured according to the AATCC ("American Association of Textile Colorists and Chemists") test method 22-1985.

On a scale wherein 0 means complete wetting and 100 means no wetting, the yarn and fabric of this invention was rated 100 and the Comparison was rated 0. Complete results of the tests are given in the Table below.

| | Never-dried fibers of this invention | Comparison | Dried Aramid Fibers 0.8% | Dried Aramid Fibers 2.5% |
|---|---|---|---|---|
| Fabric | 100 | 0 | 40–80* | ** |
| Yarn | 100 | 0 | variable ave. 50 | 100 |
| Filaments | 100 | 0 | variable ave. 50 | 100 |

*could be woven only at low speeds
**could not be woven

Obtaining a 100% hydrophobic yarn and maintaining this property at the fabric level without any additional treatment is the key advantage of the invention.

EXAMPLE 4

In this example, wickability of a yarn of this invention treated in the never-dried condition to a level of 1% using hexadecyl ketene dimer was compared with a yarn treated in dried condition to levels of 1% and 3% using hexadecyl ketene dimer and a Comparison yarn. The yarns were all aramid of 1000 denier and was suspended with one end held in an aqueous 0.05% methylene blue solution by a 50 g weight. Wickability is the height (mm) of the methylene blue solution as a function of time.

Low wickability is a desirable yarn quality. This example shows the superiority of the fiber of this invention versus the other yarns tested. The capillary process is almost completely disrupted.

| | Wickability | | | |
|---|---|---|---|---|
| | (Height (mm)) | | | |
| Time | Never-dried Fibers of | | Dried Fibers | |
| (min) | This Invention | Comparison | 1% | 3% |
| 0.5 | 0 | 10 | 3–5 | 0 |
| 1 | 1 | 16 | 6–8 | 2 |
| 2 | 3 | 18 | 10–12 | 4 |
| 5 | 4 | 34 | 13–14 | 5 |
| 10 | 6 | 52 | 19–28 | 8 |
| 15 | 8 | 67 | 28–36 | 10 |

EXAMPLE 5

In this example, fabrics made from the never-dried aramid yarn of this invention were compared for ballistic resistance with fabrics made from Comparison yarn.

The ballistic test method for personal armours ($V_{50}$ test) was carried out according to the NATO standardization agreement STANAG 2920.

The $V_{50}$ ballistic limit velocity for a material or armour is defined as that velocity for which the probability of penetration of the chosen projectiles is exactly 0.5, using the Up and Down firing method and calculation described below.

The Up and Down firing method

The first round shall be loaded with the amount of propellant calculated to give the projectile a velocity equivalent to the estimated $V_{50}$ ballistic limit of the armour. If the first round fired produces a complete penetration, the second round shall be loaded with a fixed decrement of propellant calculated to produce a velocity about 30 m/s lower than the first. If the first round fired results in a partial penetration, the second round shall be loaded with a fixed increment of propellant calculated to produce a velocity about 30 m/s higher than the first round. Upon achieving the first set of penetration reversals, the propellant charge should be adjusted with the fixed amount to yield an increment or decrement of velocity of about 15 m/s. Firing will then continue in accordance with a given procedure to obtain an estimate of the $V_{50}$ (BLP) [Ballistic Limit Protection].

$V_{50}$ calculation

After a number of projectiles have been fired, the $V_{50}$ is calculated as the average of the velocities recorded for the three highest velocities for partial penetration and the three lowest velocities for complete penetration provided that all six velocities fall within a range of 40 m/s.

The following tables show that fabric made from yarns of this invention offers the same ballistic resistance as fabric made from Comparison yarns in the case of fragment resistance; and offers a very significantly increased resistance in the case of bullets. The ballistic (bullet) performance ($V_{50}$: see test procedure) is improved by 8% in the dry stage and by 10% in the wet stage.

| | Fragment $V_{50}$ | |
|---|---|---|
| pack | $V_{50}$ (m/sec) This Invention | $V_{50}$ (m/sec) Comparison |
| 1 | 447 | 451 |
| 2 | 451 | 450 |
| 3 | 453 | 451 |
| 4 | 457 | 458 |
| average | 452 | 452 |

Each pack was made using 12 layers of fabric woven from 1000 denier aramid yarn at a density of 8.3×8.3 ends per centimeter.

The fabric ballistic resistance was measured according to the NIJ "National Institute of Justice") standard 0101.03.

| | Bullet $V_{50}$ | |
|---|---|---|
| dry/wet | $V_{50}$ (m/sec) Comparison | $V_{50}$ (m/sec) This Invention |
| Dry | 457 | 496 |
| Wet | 447 | 493 |

Each pack was made using 22 layers of fabric woven from 1500 denier aramid yarn in fabric style 728–220 g/m$^2$.

This example shows that fabric woven from the aramid fibers of this invention exhibit ballistic performance which is improved in comparison with fabrics woven from the same aramid fibers but untreated by ketene dimer.

The bullet projectile was; 9mm FMJ 124 grain

EXAMPLE 6

In this example, composite panels made from fabrics using the yarn of this invention were compared for ballistic resistance with panels made from fabrics using Plates (250 mm×300 mm) made from 24 layers of fabric (1500 den, 220 g/m$^2$) were impregnated with 18% phenol resin. The plate molding was done at 160° C. under 20 bar for 30 min. Plates were made using fabric with yarn of this invention and fabric with Comparison yarn. Firing on the plates was performed with 17 grain fragment projectiles according to the STANAG 2920 method described previously.

Plates made using fiber of this invention exhibited a 20% higher ballistic resistance than plates made using Comparison yarn.

EXAMPLE 7

In this example, aramid fiber samples of 1500 denier were immersed for 30 days in a glycol solution (50% water-50% commercial ethylene glycol) maintained at 120° C. After this 30 day immersion, the fiber samples were drained, washed with distilled water, and dried.

The fiber samples were then tested for tenacity. The percentage of the initial tenacity retention determines the fiber resistance to glycol exposure.

Aramid fibers treated in the never-dried condition to a level of 1.5 % using hexadecyl ketene dimer by the process of the present invention exhibited a 30% higher resistance to glycol than the Comparison under conditions, as defined above, while aramid fibers treated in the dried condition to a level of 1.5% using hexadecyl ketene dimer exhibited only a 5% higher resistance of glycol than the Comparison.

EXAMPLE 8

In this example, never-dried aramid yarn of 1420 denier was coated off-line at a rate of about 300 meters/-minute and dried at 200° C. The yarns were formed into unidirectional bars with 60 weight percent fiber and 40 weight percent epoxy matrix resin cured at 177° C. The bars were used to determine Short Beam Shear Strength (SBSS) and were compared with bars made from Comparison yarn.

The nature of the fiber-resin interface in aramid composites is especially important. In aramid composites, the optimum level of adhesion depends upon the specific composite function. In composites where tensile strength and modulus are the key design criteria, a moderate adhesion level leads to improved performance. This is particularly important for filament wound composite structures such as, for example, high performance pressure vessels. In this case, to improve the strength translation, one approach is the use of a low adhesion "released" fiber.

The fiber of this invention exhibits reduced adhesion to matrix resins and offers significant advantage in these types of application. The method often used to predict the behavior of a fiber in such applications is to measure the SBSS of composite bars including the fibers. It is known that reducing SBSS by 30 to 50% leads to a final performance improvement up to 50% in the case of pressure vessels.

The SBSS for this example was measured according to ASTM D 2344–84 and the SACMA ("Supplies of Advanced Composite Materials Association") recommended Method SMR 8-88.

The SBSS for aramid fibers treated in the never-dried condition to a level of 1.2% using hexadecyl ketene dimer of the process of this invention was found to be 33 MPa while that of the Comparison yarn was 54 MPa. Fibers of this invention resulted in a reduction of SBSS by 39.6%. The same tests conducted with aramid fibers treated in the dried condition to levels of 1.2% and 4 % using hexadecyl ketene dimer, coated at about 300 meters/minute and dried at 200° C., resulted in SBSS values of 52 MPa and 34 MPa, respectively.

I claim:

1. A fabric woven from aramid fibers having a surface coated by a reaction product of the aramid and a surface reactant wherein the reaction product was formed at the surface of a never-dried aramid fiber, wherein the surface reactant was applied to the aramid fiber while the aramid was swollen with 15 to 200 percent water, the reaction product was formed, and the coated aramid fiber was dried, and wherein the surface reactant comprises a ketene dimer of the general formula $$[R^1R^2C_2O]—[R^{1'}R^{2'}C_2O]$$

wherein each of the groups $R^1$ and $R^{1'}$, which may be same or different, are alkyl or alkenyl and have from 8 to 24 carbon atoms; and each of the groups $R^2$ and $R^{2'}$, which may be same or different, are $C_1$–$C_3$-alkyl, $C_1$–$C_4$-alkenyl, or hydrogen.

* * * * *